US010667625B2

(12) United States Patent
Flaunty et al.

(10) Patent No.: US 10,667,625 B2
(45) Date of Patent: Jun. 2, 2020

(54) BABY CARRIER

(71) Applicant: Phil and Teds Design Limited, Wellington (NZ)

(72) Inventors: Evarn Flaunty, Lower Hutt (NZ); Campbell Douglas Gower, Wellington (NZ)

(73) Assignee: Phil and Teds Design Limited, Wellington (NZ)

( * ) Notice: Subject to any disclaimer, the term of this patent is extended or adjusted under 35 U.S.C. 154(b) by 0 days.

(21) Appl. No.: 16/207,829

(22) Filed: Dec. 3, 2018

(65) Prior Publication Data

US 2019/0150633 A1 May 23, 2019

Related U.S. Application Data

(63) Continuation of application No. 15/509,180, filed as application No. PCT/NZ2015/050124 on Aug. 28, 2015, now Pat. No. 10,172,477.

(51) Int. Cl.
*A47D 13/00* (2006.01)
*A47D 13/02* (2006.01)

(52) U.S. Cl.
CPC ..... *A47D 13/025* (2013.01)

(58) Field of Classification Search
CPC ..... A47D 13/025
USPC ..... 224/259
See application file for complete search history.

(56) References Cited

U.S. PATENT DOCUMENTS 6,098,857 A 8/2000 Le Gal
6,179,175 B1 * 1/2001 Painter ..... A45F 3/08 224/153
6,415,969 B1 7/2002 Higuchi
8,172,116 B1 5/2012 Lehan
(Continued)

FOREIGN PATENT DOCUMENTS

DE 3916370 A1 11/1990
EP 2622994 B1 4/2015
(Continued)

OTHER PUBLICATIONS

"Four Position 360 Baby Carrier—grey" Ergobaby.com, Retrieved Mar. 6, 2017 from https://store.ergobaby.com/baby-carrier/four-position-360/grey ,14 pages.
(Continued)

*Primary Examiner* — Peter N Helvey
(74) *Attorney, Agent, or Firm* — Holzer Patel Drennan

(57) ABSTRACT

Described herein is a baby carrier and insert therein. In particular, a multi functional baby carrier that transitions seamlessly from one mode to another to allow the carrying of a child from newborn baby through to a toddler wherein the main body forms an adjustable seat width position to address ergonomic concerns when in a particular carrying mode. The main body portion also comprises a hands through pouch configured to allow a wearer to pass their hands through for additional support when carrying the child. The insert includes an adjustable length back support and is configured to engage with the main body of a multi functional baby carrier without requirement of separate fasteners to retain the insert within the main body of the multi functional baby carrier.

28 Claims, 9 Drawing Sheets

(56) References Cited

U.S. PATENT DOCUMENTS

| | | | |
|---|---|---|---|
| 9,220,352 | B2 | 12/2015 | Frost |
| 9,750,353 | B2 | 9/2017 | Antunovic |
| 2006/0076812 | A1 | 4/2006 | Ward |
| 2008/0231097 | A1 | 9/2008 | Rumack |
| 2008/0277981 | A1 | 11/2008 | Sizemore |
| 2010/0187268 | A1 | 7/2010 | Rosen |
| 2010/0308088 | A1 | 12/2010 | Lindblom |
| 2011/0042429 | A1 | 2/2011 | Frost |
| 2012/0118922 | A1 | 5/2012 | Buffinton |
| 2012/0217273 | A1 | 8/2012 | Gunter |
| 2013/0327797 | A1 | 12/2013 | Bray |
| 2014/0284361 | A1 | 9/2014 | Wang |
| 2014/0284362 | A1 | 9/2014 | Halverstadt |
| 2015/0136817 | A1 | 5/2015 | Schaarschmidt |
| 2015/0313376 | A1 | 11/2015 | Winger |
| 2016/0120334 | A1 | 5/2016 | Pond et al. |
| 2017/0238722 | A1 | 8/2017 | Flaunty |

FOREIGN PATENT DOCUMENTS

| | | | |
|---|---|---|---|
| JP | 2006141680 | A | 6/2006 |
| WO | 2013037514 | A1 | 3/2013 |
| WO | 2014040726 | A1 | 3/2014 |
| WO | 2014160355 | A1 | 10/2014 |

OTHER PUBLICATIONS

International Search Report and Written Opinion issued by the Australian Patent Office dated Nov. 25, 2015 for PCT/NZ2015/050124, 21 pages.

International Preliminary Report on Patentability issued by the Australian Patent Office dated Dec. 1, 2016 for PCT/NZ2015/050124, 13 pages.

* cited by examiner

BABY CARRIER

CROSS REFERENCE TO RELATED APPLICATIONS

This Application is a continuation of U.S. patent application Ser. No. 15/509,180, filed Mar. 6, 2017, which is a 35 U.S.C. § 371 National Stage application of PCT Application No. PCT/NZ2015/050124, filed on Aug. 28, 2015, which claims the benefits and priority of prior New Zealand Patent Application No. 703119, filed on Dec. 18, 2014, and New Zealand Patent Application No. 630443, filed on Sep. 8, 2014. The entire disclosures of the above applications are incorporated by reference in their entirety as part of this document.

TECHNICAL FIELD

Described herein is a baby carrier. More specifically, a multi functional baby carrier that transitions seamlessly from one mode to another to allow the carrying of a child from a newborn baby through to a toddler while addressing ergonomic concerns when in a particular carrying mode.

BACKGROUND ART

Most baby or child carriers are worn by parents who want to be close to their young children as they go about their daily schedules. Hence there are currently any number of wearable child carriers on the market which afford the wearer freedom of hand and arm movement while transporting a child that is secured in the carrier. In pursuit of ergonomic considerations, some of these carriers have become overly complex involving complicated mechanisms in an attempt to accommodate the growth of the child or adjust the position of the carrier mode.

There are generally four carrier modes of a baby carrier. Namely, front mode where the child can face inwards or outwards with respect to the wearer, back mode where the child faces inwards and is carried on the back of the wearer and hip mode where the child faces inwards and is carried on the hip of the wearer. However, a disadvantage of some baby carriers is that they are not multi functional and only offer limited modes such as front face inward and outward respectively. Others can only be worn on the back thus denying the child the comfort and security of a front carrier position where a child and its parent are in a face-to-face relationship.

Some of the baby carriers that do offer multi functional modes are provided with multiple harness pieces to operate in both front and back carry modes. The requirement to interchange harness pieces when changing modes hinders parents, and makes the usability of such carriers overly complicated and inconvenient, notwithstanding the use of buckles or fasteners of some baby carriers that can be difficult to manipulate when adjusting position or modes.

In addition to the above, these complex carriers are cumbersome and do not adequately take into account ergonomic considerations that can result in undue strain upon the wearer, particularly in the lumbar region. For example, the carrier may sit too low when in the back mode hindering parents' comfort, including the positioning of shoulder and waist bands creating discomfort over prolonged use and imbalance of weight distribution when the baby moves from side to side. The use of stiff padding has the effect of making the wearer feel as though the carrier is fitting imperfectly around the wearer's body shape. On a practical level, the strap placement of some baby carriers over the chest can create difficulties when breast feeding in a carrier.

With respect to the child's comfort, health and safety, some baby carriers are of concern. For example, with some baby carriers, when used with a small baby in front face out mode, the height of the carrier is not ergonomically designed as it is too high and may obstruct the baby's mouth and breathing, The position of the waistband of some carriers has the tendency to leave pressure marks on the baby's inner thighs and may affect circulation when wearing in front facing mode. In some cases, the baby's knees are not positioned anywhere near their hip height, thus in front face outward mode the carrier leaves the baby seated in an unsupported fairly narrow seat configuration leaving the legs to dangle straight down, often referred to in the industry as a 'crotch dangler'.

Ideally, a good baby carrier should mimic the way parents hold their babies in their arms and the way babies position themselves when held. When a parent holds their newborn, the newborn will automatically draw up their legs into the 'natural human position' (often referred to as the "frog-legged" position) with their knees apart. The holder instinctively places their hand under the baby's bottom and holds their baby at a height where the top of their head is easily kissed. An older child will automatically bring his/her legs up around the holder's waist so that his/her knees end up slightly higher than their bottom.

In order to establish the above 'natural human position', some baby carriers utilise a wide seat configuration when in the front inwards facing mode, so when carrying a child in this position the hips are supported through to the knees. This ergonomic structuring takes unnecessary weight off of the child's hip joints which allows for healthy development and growth of all joints throughout the legs and hips. Conversely, the seat width may be narrowed when in the front outwards facing mode such that the hips and legs are not too far spread (as the seat would be too wide for the legs to wrap around), which negates the ergonomically accurate natural human position and causes discomfort to the child. Some baby carriers do not have the ability to alter the seat width, but those that do provide the feature of ergonomically accurate seat narrowing use complicated fastenings or methods which are far less intuitive and slow to re-configure, For example, one prior art baby carrier requires the parent to remove the bands surrounding the waistband then pull together and fasten. This form of functionality requires far more fastenings on the carrier itself to make it achievable, which often adds confusion to the parent who is trying to assess which fastening does what and where it should be secured. Furthermore, the bands that are drawn in and secured are not padded, and when fastened are positioned in a location which interferes with a comfortable smooth fabric surface for the child. Another carrier utilises fasteners which are difficult to operate and are located on an exterior facing outside of the carrier which not only proves intrusive to the overall aesthetics of the carrier itself, but the fasteners can often become caught on objects when in use.

Also, the use of extra padding and fabric of some carriers can lessen the carriers' breathability arid infants may overheat after extended use or in warm climates.

From the above it can be seen that there is a need for an improved multi function baby carrier that addresses ergonomic concerns, mimics the way a baby is carried in the natural human position and overcomes disadvantages of known baby carriers or at least provides the public with a useful choice.

Further aspects and advantages of the product will become apparent from the ensuing description that is given by way of example only.

SUMMARY

Described herein is a baby carrier. More specifically, a multi functional baby carrier that transitions seamlessly from one mode to another to allow the carrying of a child from newborn baby through to a toddler, wherein the main body forms an adjustable seat width position to address ergonomic concerns when in a particular carrying mode. The main body portion also comprises a hands through pouch configured to allow a wearer to pass their hands through for additional support when carrying the child. An adjustable length insert is also configured to engage with the main body of the multi-functional baby carrier without requirement of separate fasteners to retain the insert within the main body of the multi functional carrier.

In a first aspect there is provided a multi functional baby carrier comprising:

two strap loops which are interconnected and configured to extend around shoulder or back areas of a wearer;

a main body attached to the two strap loops, the main body forming a seat portion to support a baby having at least two moveable side members configured to adjust a width of the seat portion, wherein the adjustment of the width of the seat portion is altered to a narrow position when a portion of the side members are folded back substantially towards a middle section of the main body and retained in position when in a front face outward mode.

In a second aspect there is provided a multi functional baby carrier comprising:

two strap loops which are interconnected and configured to extend around shoulder or back areas of a wearer;

a main body attached to the two strap loops, the main body forming a seat portion to support a baby having at least two moveable side members attached to the main body, wherein a piece of material overlaps the main body to form a pouch configured to allow a wearer to pass their hands right through an opening created therein between the piece of material and the main body.

In a third aspect there is provided an insert configured to engage with a main body of a multi functional baby carrier without requirement of separate fasteners to retain the insert within the main body of the multi functional baby carrier, the insert comprising:

a back support; and a base or seat, wherein a length of the back support is extendible relative to the base or seat.

Advantages of the above include side members that allow ease of adjustability to alter the width of the seat portion by merely folding back a portion of the side members towards the centre of the carrier. The narrowed front outward facing seat mode allows for a child who is 6 months or older to sit ergonomically front face outwards to simulate the ergonomically accurate natural human position to allow for comfort and healthy development and growth of all joints throughout the legs and hips, Conversely, when the multifunction baby carrier is in the front inwards facing mode, the seat portion can be easily converted back to a wide seat position to allow the child to be carried in a seated position with slightly widespread legs—the 'natural human position'. A further advantage of the seat portion is that it has been dimensioned to be wide enough to be used as a support underneath the thighs which helps to take the weight off of the child's hip joints, with support following through towards the knee bend when in the front inwards facing mode. The multi functional baby carrier is advantageously configured with a hands through pouch or pocket designed for wearers to be able to place their hands right through an opening created therein between the material and the main body of the multi functional baby carrier. This allows for a closer connection with their child, added warmth, extra support if desired and a design solution to an intuitive position in which parents seem to place their hands when carrying a child. Also, an adjustable insert that engages with the main body of the multi functional carrier is retained without the requirement of separate fasteners, where the insert provides additional head and neck support for newborn babies.

BRIEF DESCRIPTION OF THE DRAWINGS

Further aspects of the baby carrier apparatus will become apparent from the following description that is given by way of example only and with reference to the accompanying drawings in which.

DETAILED DESCRIPTION

Figure 1:
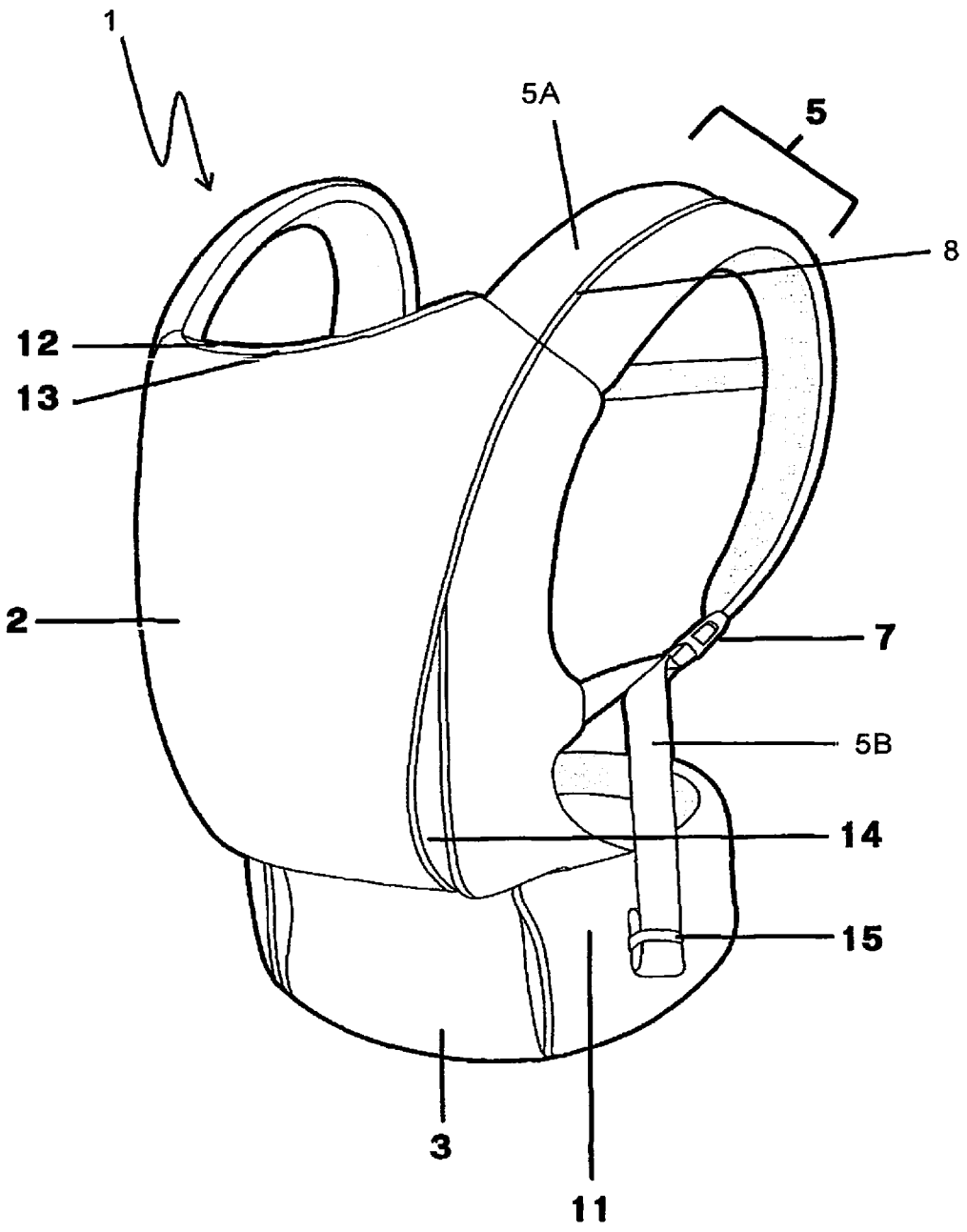
FIG. 1 illustrates a front perspective view of a preferred embodiment of the baby carrier.

As noted above, described herein is a baby carrier. More specifically, a multi functional baby carrier that transitions seamlessly from one mode to another to allow the carrying of a child from newborn baby through to a toddler, wherein the main body forms an adjustable seat width position to address ergonomic concerns when in a particular carrying mode. The main body portion also comprises a hands through pouch configured to allow a wearer to pass their hands through for additional support when carrying the child. An adjustable length insert is also configured to engage with the main body of the multi-functional baby carrier without requirement of separate fasteners to retain the insert within the main body of the multi functional carrier.

For the purposes of this specification, the term 'about' or 'approximately' and grammatical variations thereof mean a quantity, level, degree, value, number, frequency, percentage, dimension, size, amount, weight or length that varies by as much as 30, 25, 20, 15, 10, 9, 8, 7, 6, 5, 4, 3, 2, or 1% to a reference quantity, level, degree, value, number, frequency, percentage, dimension, size, amount, weight or length.

The term 'substantially' or grammatical variations thereof refers to at least about 50%, for example 75%, 85%, 95% or 98%.

The term 'comprise' and grammatical variations thereof shall have an inclusive meaning—i.e. that it will be taken to mean an inclusion of not only the listed components it directly references, but also other non-specified components or elements.

The term 'multi functional' or grammatical variations thereof refers to the four carrying modes of the baby carrier in which the apparatus has been designed to ensure four key ergonomic considerations have been met by design and construction elements (particularly in a front face out mode as described below) for health, safety and comfort of both child and parent. Namely, these four ergonomic considerations are as follows:

1. 'Close enough to kiss'—The child is positioned high on the parent's body when worn. This assists with parent stability when carrying a child and also helps to distribute the weight carried across the parent's torso more evenly, increasing parent carrying comfort.
2. 'Chin off the chest'—When a child is positioned higher on their parent's torso the distance of that child's mouth and nose from the parent's torso is increased, making it much less likely that the airways will be obstructed in any way by the body of the parent. When carrying a newborn or a younger infant this is a consideration which must be vigilantly adhered to due to the lack of control the child has of his/her own head and neck movement.
3. 'C-curve through the spine'—This is when the position of the child carried is supported in a position and held in a natural slight C-shape. If a child's back is arched uncomfortably backwards or slumped too far forward, this can cause strain on the spine of a growing child and can (over extended periods of time) cause discomfort to the child or impact detrimentally on their muscular and spinal development if they already have a genetic pre-disposition to this condition. The C-curve spinal position of the child also benefits parent carrying comfort/ergonomics, as the child's weight is much more centred which makes the load on the parent more evenly dispersed across and balanced across their torso.
4. 'A natural human position'—(sometimes referred to as the frog-legged position). This is when the child being carried is in a seated position with slightly widespread legs. An ideal carrier seat is dimensioned so that it is wide enough to be used as a support underneath the thighs which helps to take the weight off of the child's hip joints, with support following through towards the knee bend. The knees should be positioned high up to be in line with the hip joints as per the International Hip Dysplasia guidelines. This ergonomic structuring takes unnecessary weight off of the child's hip joints which allows for healthy development and growth of all joints throughout the legs and hips.

The term 'carry mode' or grammatical variations thereof refers to a particular carry mode of the baby carrier. Namely, front mode where the child can face inwards or outwards with respect to the wearer, back mode where the child faces inwards and is carried on the back of the wearer and hip mode where the child faces inwards and is carried on the hip of the wearer.

The term 'baby' or grammatical variations thereof refers to a young human who is supported by the carrier. This term should not be seen as limiting and may be used interchangeably throughout the specification with other terms such as newborn, infant, toddler or child when referring to a particular growth stage of the young human.

The term 'fastener' or grammatical variations thereof refers to a hardware device that mechanically joins or removably affixes two or more objects together. This may include, but should not be seen as limited to, a buckle, clip, runner or dome.

The term 'pouch' or grammatical variations thereof refers to a pocket-like receptacle integrated therein the baby carrier.

In a first aspect there is provided a multi functional baby carrier comprising:

two strap loops which are interconnected and configured to extend around shoulder or back areas of a wearer;

a main body attached to the two strap loops, the main body forming a seat portion to support a baby having at least two moveable side members configured to adjust a width of the seat portion, wherein the adjustment of the width of the seat portion is altered to a narrow position when a portion of the side members are folded back substantially towards a middle section of the main body and retained in position when in a front face outward mode.

The multi functional baby carrier may include four carry modes of operation. Namely, front face mode inwards or outwards, back mode and hip mode. In this way, the carrier may transition seamlessly from the preferred mode and/or to accommodate the growth stage of a child. It should be noted that the three modes (front face outwards, back and hip modes) may be referred to as the 'normal position' when referring to the side members in a wide or non-narrow position.

The two strap loops may be interconnected via an adjustment means such as a sternum strap and fastener such as a buckle. This may allow the wearer to adjust (increase or decrease) the width between the shoulder straps. In this way, this adjustment means may assist in keeping the shoulder straps in place when carrying a child.

The two strap loops may include a shoulder strap fastener in the form of a buckle, one on each side of the two strap loops. This may allow a wearer to release the buckles to detach the main body or front fabric section of the carrier from the strap loops, wherein the main body portion may be still attached to a waistband section of the carrier to lay a child in a substantially horizontal or sleeping position with minimal disturbance to the child when sleeping. Also, the straps with releasable buckles may provide an adjustable functionality to better suit a variety of wearer or child body shapes.

The loose strap ends at a distal end of the two strap loops may include an elastic band. In this way, the elastic band may keep any excess strap in a retained position by allowing the wearer to roll up the excess strap end, loop the elastic band around it and keep the strap end from dangling.

The two strap loops may include a binding or sternum strap runners positioned substantially on a middle section of each loop and running along the length of the strap. A fastener in the form of a stiff plastic clip may be configured to engage and move up and down the binding for height adjustment of the sternum strap. In this way, a wearer may easily adjust the height of the sternum strap to assist with attachment and removal of the carrier.

The main body may include a waistband attached thereto the main body, the waistband dimensioned to act as a weight distribution aid for the user. In this way, the waistband provides for a more ergonomic and comfortable carrier when in use.

The waistband may include a fastener in the form of a buckle for removably releasing the waistband from the wearer. The buckle may be dimensioned to ensure a secure connection along with a strap to allow for adjustments to be made to the width of the waistband, thereby providing an ergonomic fit for different sized wearers.

An underside of the waistband may include a layer of material that covers the moveable side members when in the front face inward, back and hip modes respectively. The layer of material may be a mesh material. In this way, the layer ensures that there will be a flat and covered surface resting on the user's hips when carrying. Furthermore, this minimises the opportunity for the fasteners which retain the side members in position to unexpectedly release or become undone in use, for example when catching on loose clothing or through wearer/child movement in use.

The two moveable side members may include fasteners in the form of domes used to removably attach the side members. The side members may be secured by two domes on each side, wherein the domes are concealed within the underside of the waistband within an open pocket when in the front face inwards, back and hip modes respectively.

The two outer domes of each side member may be un-domed and re-fastened in an inward direction to form a narrower main body section on the carrier to economically support the front face out mode such that once re-fastened into the narrow position, the side members lie underneath a layer of material positioned on an underside of the waistband. In addition to the advantages above, a side member that folds in an inwards direction does not interfere with a comfortable smooth fabric surfaces for the child compared to other carriers which also require bands surrounding the waistband to be drawn in creating a ruffled and uncomfortable surface. Furthermore, the use of a dome fastener system configured in this way simplifies the mechanism and transition to a narrow seat position relative to other carriers that require complicated fastening mechanisms which are far less intuitive and time consuming to achieve.

The waistband may include a pocket. The pocket may be located on each side of the waistband. In this way, small items such as electronic items, keys or the like may be stored in the carrier when in use and may be carefully positioned away from the body of the child for safety and comfort, thus minimising the impact on the child.

The pocket may include an opening with an elasticated mechanism configured to allow the pocket opening to revert back into position such that the pocket opening may lay substantially against the waistband when not in use. In this way, the pocket is streamlined with respect to the waistband.

The main body may include an internal hood storage pocket section wherein a hood is stored in the hood storage pocket section located therein between internal and external fabric layers. In this way, a hood utilised for weather protection, warmth and privacy (for example, when breast-feeding) may be stored out of the way when it is not required.

The hood may have an elastic edge for expanding the size of the hood and retaining the hood over a child's head.

The hood may include straps with fasteners that engage with corresponding fasteners located on the shoulder straps to retain the hood over a child's head when in use.

In a second aspect there is provided a multi functional baby carrier comprising:

two strap loops which are interconnected and configured to extend around shoulder or back areas of a wearer:

a main body attached to the two strap loops, the main body forming a seat portion to support a baby having at least two moveable side members attached to the main body, wherein a piece of material overlaps the main body to form a pouch configured to allow a wearer to pass their hands right through an opening created therein between the piece of material and the main body.

The pouch may be accessed from either side of the carrier, wherein the sides of the pouch are not enclosed. In this way, the wearer can reach all the way through the pouch and use the pouch as an additional mechanism for supporting the baby when in use.

In a third aspect there is provided an insert configured to engage with a main body of a multi functional baby carrier without requirement of separate fasteners to retain the insert within the main body of the multi functional baby carrier, the insert comprising:

a back support and a base or seat, wherein a length of the back support is extendible relative to the base or seat.

As above, the baby carrier may include an insert configured to engage with the main body without requirement of separate fasteners to retain into position. In this way, the insert can easily be removed from the main body when not required. An advantage of the insert is that it provides additional support until the baby is large enough to fit securely into the main body. For example, used for newborns from 0-6 months and used in front face inwards mode. A further advantage of the insert is that the back support is extendible allowing larger/longer babies who may be still of a young age to comfortably fit within the infant insert. An adjustable size allows for extended use of the insert as babies may not outgrow the insert too quickly.

The base or seat may be movable from a first position to a second position such that the back support may be extendible relative to the base or seat.

The base or seat may be unfastened from the first position and inverted or moved upside down to the second position, such that the back support may be extendible relative to the base.

The back support may also be inverted or turned inside out where the inside or inner material of the back support may become the outside or outer material of the back support when the insert may be in an extended position or configuration. In this way, the base or seat member may remain attached to the bottom edge of the back support while allowing a second use or position of the base when in an extended configuration thereof.

The insert may include a back support that may extend in length from a range of 350-750 mm when the base or seat is in the first and second positions respectively. In one embodiment, the back support length may range from 430 mm when the base or seat is in the first position and extend to a length of 500 mm when in the second position.

The insert may include a restraint system in the form of at least one strap to secure the child within the insert. This ensures that they are secure within the carrier itself and even if physically small in stature.

The strap may include a fastener in the form of a dome to retain the strap in an adjusted position.

The fastener may be inverted where the dome located on the outside or outer strap material may become located on the inside or inner strap material when the insert may be in an extended position or configuration.

The strap may be placed over or under the baby's arms dependent on age, size or whether a parent considers a child's preference for one position or the other.

The insert may include adjustable curved side walls that fit around a body of a child in an adjusted position.

The insert may include an elevated base or seat to raise newborns in a higher position when in the carrier.

The elevated base may be manufactured out of polyurethane foam. This ensures that the newborn has a specifically cushioned base or seat for comfort.

The insert may have a foam-padded back. This provides some structural support to the insert and also acts as additional head and neck support for newborn babies. The padded qualities of the insert also help to provide warmth and cushioning.

The insert may include vertical stitch lines or seams to secure internal foam to external fabric of the carrier, wherein the seams provide extra structural integrity allowing the side walls of the carrier to curve around the baby.

Advantages of the above include:

A multifunctional baby carrier that transitions seamlessly from four modes of operation. Namely, front (inwards or outwards), back and hip;

A multifunctional carrier, which has been designed to ensure four key ergonomic considerations, has been met by design and construction elements. Namely, 'close enough to kiss', 'chin off the chest', 'C-curve through the spine', and 'a natural human position';

The inclusion of side members that allow ease of adjustability to alter the width of the seat portion by merely folding back a portion of the side members towards the centre of the carrier. This narrowed front outward facing seat mode allows for a child to sit ergonomically front face outwards to simulate the ergonomically accurate natural human position to allow for comfort and healthy development and growth of all joints throughout the legs and hips;

A side member as configured above that folds in an inwards direction does not interfere with a comfortable smooth fabric surfaces for the child compared to other carriers which also require bands surrounding the waistband to be drawn in creating a ruffled and uncomfortable surface;

The ability of the seat portion to be easily converted back to a wide seat position to allow the child to be carried in a seated position with slightly widespread legs—the 'natural human position';

The inclusion of a sternum strap to allow the wearer to adjust (increase or decrease) the width between the shoulder straps;

A shoulder strap buckle that allows a wearer to release the buckles to detach the main body or front fabric section of the carrier from the strap loops, to assist in laying a child in sleeping position with minimal disturbance:

Strap loops that include an elastic band to keep any excess strap in a retained position;

A waistband attached to the main body dimensioned to act as a weight distribution aid;

The use of a layer of material that covers the moveable side members when in the front face inward, back and hip modes respectively. In this way, the layer ensures that there will be a flat and covered surface resting on the user's hips when carrying. Furthermore, this minimises the opportunity for the fasteners which retain the side members in position to unexpectedly release or become undone in use;

The two moveable side members include dome fasteners to easily removably attach the side members. The use of a dome fastener system configured in this way simplifies the mechanism and transition to a narrow seat position relative to other carriers that require complicated fastening mechanisms which are far less intuitive and time consuming to achieve;

As above, the domes are also concealed within the underside of the waistband within an open pocket when in the front face inwards, back and hip modes respectively to prevent unexpected release and so that the domes do not rest against a wearer's or child's skin.

The waistband includes a pocket with an elasticised mechanism. Small items can be stored on the carrier and are positioned away from the body of a child for safety and comfort. Also, the pocket opening can revert back into position such that the pocket opening lays substantially against the waistband when not in use such that the pocket is streamlined with respect to the waistband;

The use of an elongate main body or front panel on the carrier helps to ensure that the fabric support reaches the shoulder blades or is at least higher than the child when being used in back mode. This increases safety to ensure the child does not fall back and out of the carrier and is firmly supported within the structure. This compares with short front panels of prior art carriers that allow for too much side to side upper body movement of the child when being carried. This also disturbs the overall centralisation of the child's weight which in turn has negative impacts on the parent ergonomics and stability.

The main body includes an internal hood storage pocket section for a hood. The hood can be utilised for weather protection, warmth and privacy and can be stored out of the way when not required;

An optional insert configured to engage with the main body without requirement of separate fasteners to retain into position. The insert can easily be adjusted for length and removed from the main body when not required. A further advantage of the insert is that it provides additional support until the baby is large enough to fit into the main body; and The multi functional baby carrier is advantageously configured with a hands-through pouch or pocket designed for wearers to be able to place their hands right through an opening created therein between the material and the main body. This allows for a closer connection with their child, added warmth, extra support if desired and a design solution to an intuitive position in which parents seem to place their hands when carrying a child.

The embodiments described above may also be said broadly to consist in the parts, elements and features referred to or indicated in the specification of the application, individually or collectively, and any or all combinations of any two or more said parts, elements or features, and where specific integers are mentioned herein which have known equivalents in the art to which the embodiments relates, such known equivalents are deemed to be incorporated herein as of individually set forth, Where specific integers are mentioned herein which have known equivalents in the art to which this invention relates, such known equivalents are deemed to be incorporated herein as if individually set forth.

WORKING EXAMPLES

The above described baby carrier apparatus is now described by reference to specific examples.

Example 1

Figure 2:
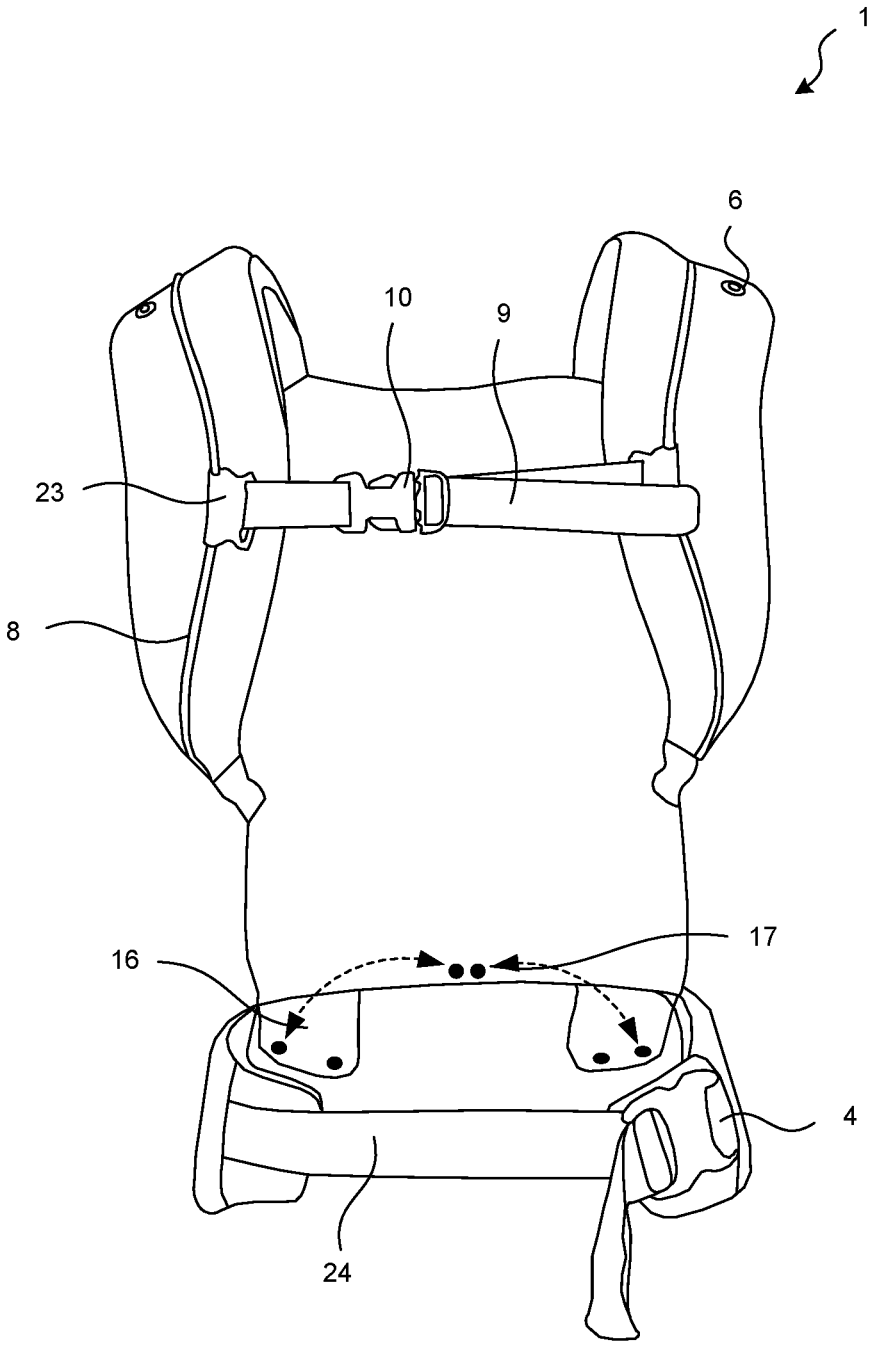
FIG. 2 illustrates a back view of the same baby carrier of FIG. 1.

With reference to FIGS. 1 and 2, a perspective front view and rear view of a baby carrier apparatus 1 respectively is shown that includes two straps or strap loops 5 comprising shoulder strap pads 5A, shoulder adjuster straps 5B, waist band 3 and sternum strap 9. The shoulder strap pads 5A are formed in a smooth continuous curve with a foam insert and the outer fabric pattern is dimensioned to be greater than the 3D mesh inside layer, such that a join line between the materials is located on the bottom third line of the side of the strap (not shown).

The two strap loops 5 are interconnected via an adjustment means such as a sternum strap 9 and fastener such as a 20 mm buckle 10 best seen in FIG. 2. This allows the wearer to adjust (increase or decrease) the width between the shoulder straps 5. The two strap loops 5 also include a shoulder strap fastener in the form of a 25 mm buckle 7, one on each side of the two strap loops 5 to correspond to the shoulder adjuster strap 5B. This allows a wearer to release the buckles to detach the main body 2 or front fabric section of the carrier 1 from the strap loops 2, such that the main body portion 2 is still attached to a waistband 3 section of the carrier 1. This configuration assists to lay a child in a substantially horizontal or sleeping position with minimal disturbance to the child when sleeping. Also, the shoulder adjuster straps 5B with releasable buckles 7 provide an adjustable functionality to better suit a variety of wearer or child body shapes. The shoulder adjuster strap 5B comprises inner black 75 GSM rip stop fabric and outer fabric 14-B009 (B) cotton 284 gsm (25 mm wide) material that is centre stitched to prevent fabric bunching of the clip or buckle 7 when adjusting the strap 5B. Reinforcing box stitch is utilised under the top layer of fabric to connect the strap to the buckle and main body respectively so that the stitching adds strength, but is not visible. The liner fabric of the main body section is 002/14 100% cotton interlock 210 gsm material.

An elastic band or loop 15 is attached to a distal end of the shoulder adjuster strap 5B to keep excess strap in a retained position by allowing a parent or wearer to roll up the excess strap end, loop the elastic band 15 around it and keep the strap end from dangling.

The two strap loops 5 include a binding or sternum strap runner tube 8 positioned on a middle section of each loop along the length of the strap 5. A stiff plastic clip 23 is configured to engage and move up and down the binding 8 for height adjustment of the sternum strap 9.

The waistband 3 is attached to the main body 2 to act as a weight distribution aid for the user and provides for a more ergonomic and comfortable carry in use. A buckle 4 is utilised for removably releasing the waistband 3 from the wearer and is dimensioned to ensure a secure connection along with a strap 24 to allow for adjustments to be made to the width of the waistband 3, thereby providing an ergonomic fit for different sized wearers. The underside of the waistband 3 includes a mesh layer of material that covers the moveable side members 16 when in the front face inward, back and hip modes respectively. The mesh layer ensures that there will be a flat and covered surface resting on the user's hips when carrying. Two dome fasteners 17 are used to removably attach the side members 16 and are concealed within the underside of the waistband 3 within an open pocket (not shown) when in the front face inwards, back and hip modes respectively. As best seen in FIG. 2, the two outer domes 17 of each side member 16 are un-domed and re-fastened in an inward direction (as shown by arrows) to form a narrower main body section 2 on the carrier 1 to ergonomically support the front face out mode see mode description further below. Once the domes 17 are re-fastened into the narrow position, the side members 16 lie underneath a mesh layer positioned on an underside of the waistband 3. The waistband 3 includes a pocket 11 located on each side of the waistband 3 to store electronic or keys or the like (not shown) positioned away from the body of the child for safety and comfort, The pocket 11 includes an opening with an elasticated mechanism configured to allow the pocket 11 opening to revert back into position such that is streamlined with respect to the waistband 3 when not in use.

An internal hood storage pocket section 13 allows for storage of a hood 12 and is located between internal and external fabrics. The hood 12 is utilised for weather protection, warmth and privacy and is stored out of the way when not required. The hood 12 has an elastic edge for expanding the size of the hood 12 and retaining the hood 12 over a child's head. The hood 12 has straps with fasteners that engage with corresponding fasteners 6 located on the shoulder strap pads 5A to retain the hood 12 over a child's head when in use.

The main body 2 includes a pouch 14 configured to allow a wearer to pass their hands right through the opening and can be accessed from either side of the carrier 1.

Figure 3:
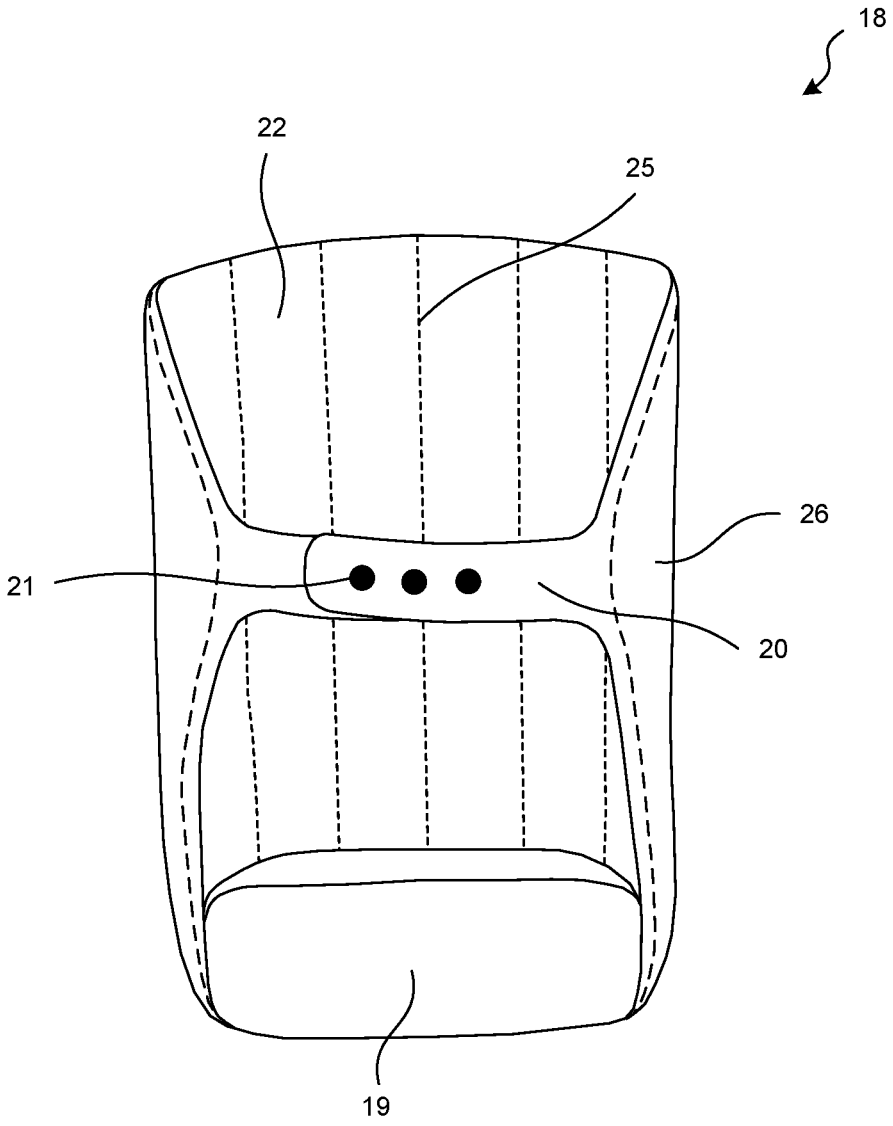
FIG. 3 illustrates a front view of an insert embodiment with a base or seat in a first position for use with the baby carrier of FIG. 1.
Figure 4:
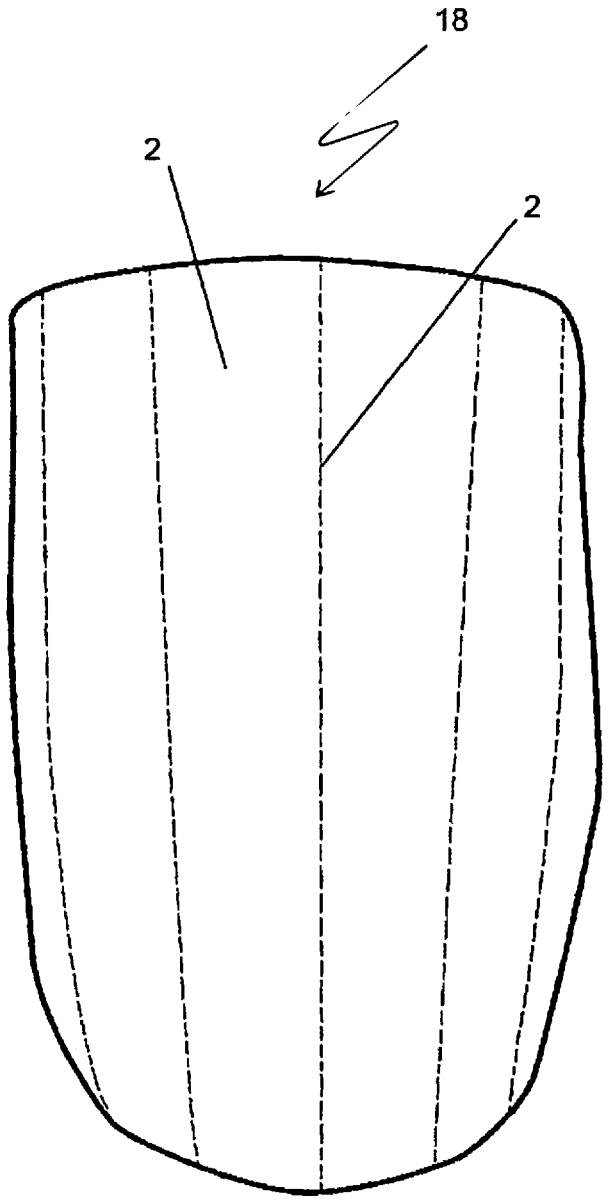
FIG. 4 illustrates a rear view of the insert embodiment of FIG. 3.

FIGS. 3 and 4 show a front and rear view respectively of an insert 18 comprising a seat 19, dome fasteners 21, a restraint system in the form of straps 20, and a foam padded back 22 with seams 25. The insert 18 is configured to engage with the main body 2 of the carrier 1 without requirement of separate fasteners to retain in position and provides additional support until a baby (newborns from 0-6 months) is large enough to fit into the main body 2. when used in front face inwards mode as described below. A dome fastener 21 is used to retain the strap 20 in an adjusted position where the strap 20 is placed over or under the arms dependent on age, size or preference. The insert 18 includes adjustable curved side walls 26 that fit around a body of a child when in the adjusted position. The base or seat 19 is elevated to raise newborns to a higher position when in the carrier 1 and is manufactured out of polyurethane foam for comfort. A foam padded back 22 provides some structural support to the insert 18 and also acts as additional head and neck support for newborn babies. The use of vertical stitch lines or seams 25 secure internal foam to external fabric of the carrier and provide extra structural integrity allowing the side walls 26 of the carrier 1 to curve around the baby.

Figure 11:
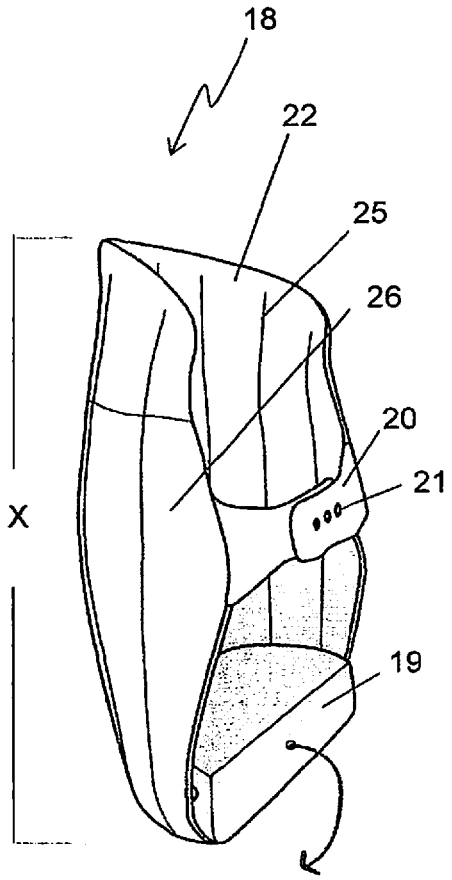
FIG. 11 illustrates a perspective view of an insert embodiment with a base or seat in a first position for use with the baby carrier of FIG. 1 in a front outwards facing mode.
Figure 12:
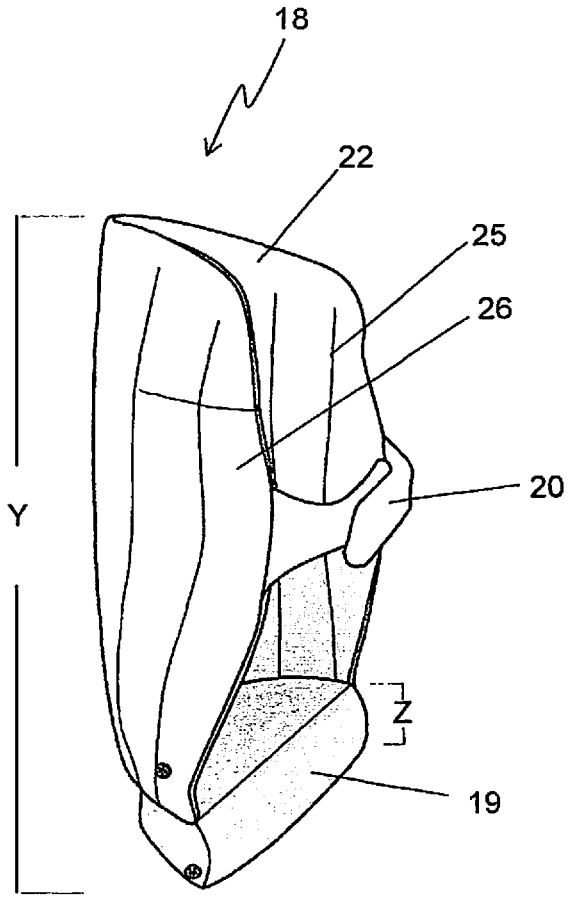
FIG. 12 illustrates a perspective view of an insert embodiment with a base or seat in a second position for use with the baby carrier of FIG. 1 in a front outwards facing mode.

FIG. 11 shows a front view of the insert 18 (as per FIG. 3) comprising a seat 19 in a first position where the seat is domed to the to the curved side walls 26 allowing for a foam padded back with a height of 430 mm as indicated by X. A curved arrow on the seat 19 as indicated in FIG. 11 shows that the seat 19 may be unfastened, then inverted "flipped over" or moved upside down to a second position as shown in FIG. 12, such that the back support 22 may be extendible by an exemplary further 70 mm relative to the base as indicated by Z i.e. an insert with a back height of 500 mm as indicated by Y.

MODES OF OPERATION

Example 2—Front Inwards Facing (Mode 1)

Figure 5:
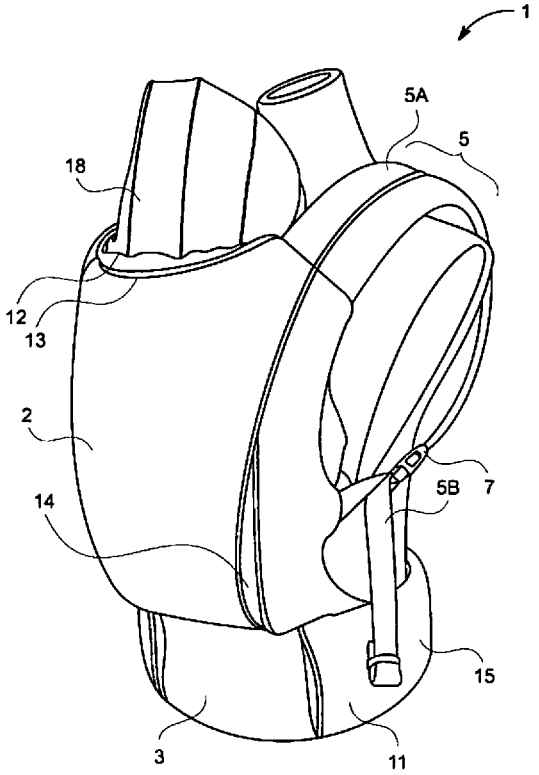
FIG. 5 illustrates a perspective view of the baby carrier of FIG. 1 in a front inwards facing mode with insert.
Figure 6:
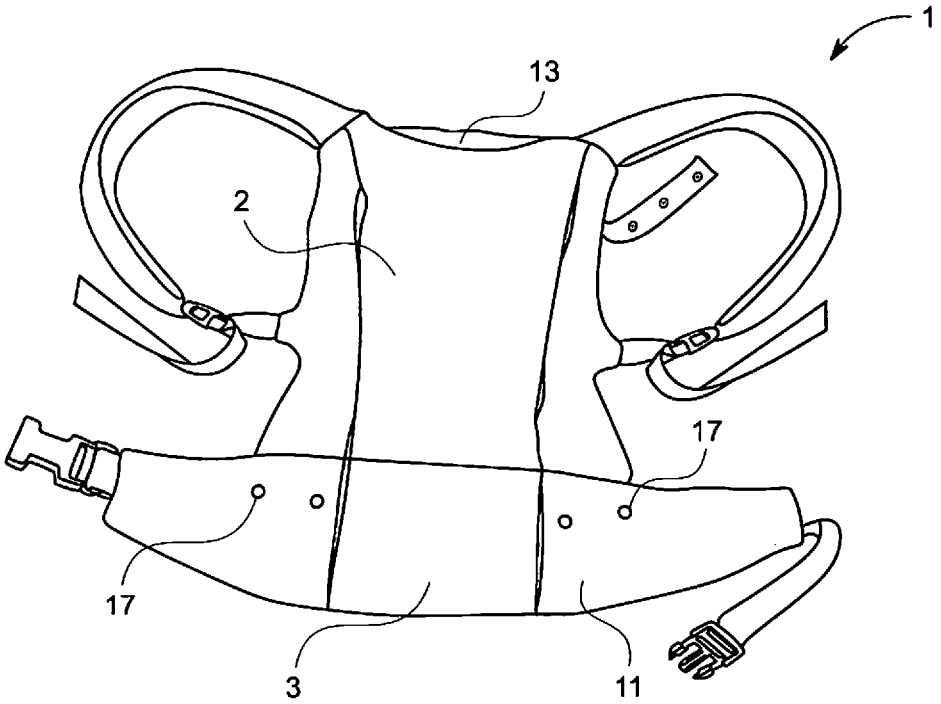
FIG. 6 illustrates a plan view of the baby carrier of FIG. 1 in a front inwards facing mode.

With reference to FIGS. 5 and 6, a perspective and plan view respectively is shown of a baby carrier apparatus 1 in front mode where the child faces inwards with respect to the wearer. Also shown is the optional insert 18. This is the recommended position that a newborn or child under 6 months should be carried in (along side the use of the infant insert 18 as shown). In this mode, the seat width is in its widest configuration with the seat domes 17 being fastened in their normal position i.e. on the inside of the waistband 3 on either side of the parents' hip, best seen in FIG. 6.

The use of the insert 18 is especially important when carrying a newborn or a child in this mode who does not have his own head/neck control (normally under 5-6 months in age) in order to provide optimum ergonomic support. The infant insert 18 provides head and neck support needed for such a young child, which keeps the chin off the chest, leaving the airways clear. As above, the insert 18 also houses a soft base or seat 19 which lifts the child upwards on the parent's torso ensuring they are close enough to kiss.

Example 3—Front Outwards Facing (Mode 2)

Figure 7:
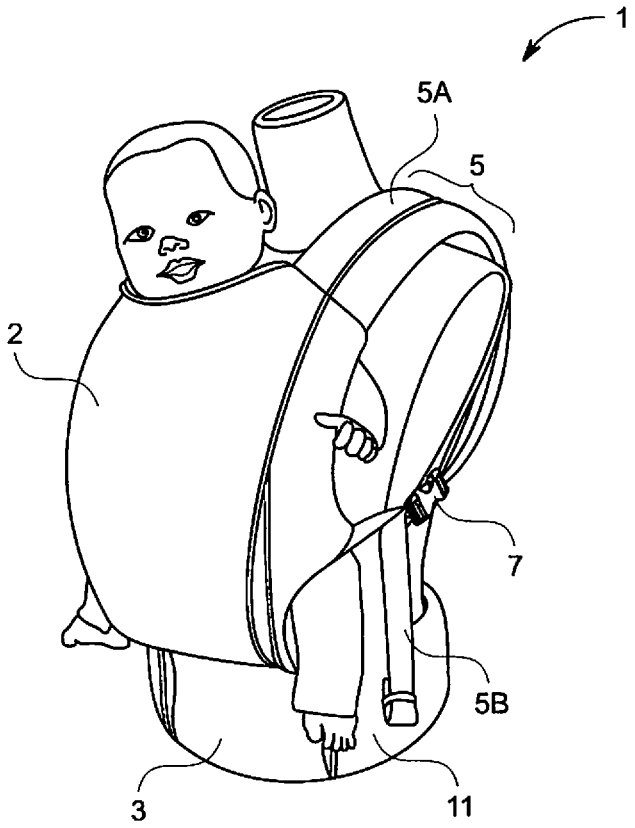
FIG. 7 illustrates a perspective view of the baby carrier of FIG. 1 in a front outwards facing mode.
Figure 8:
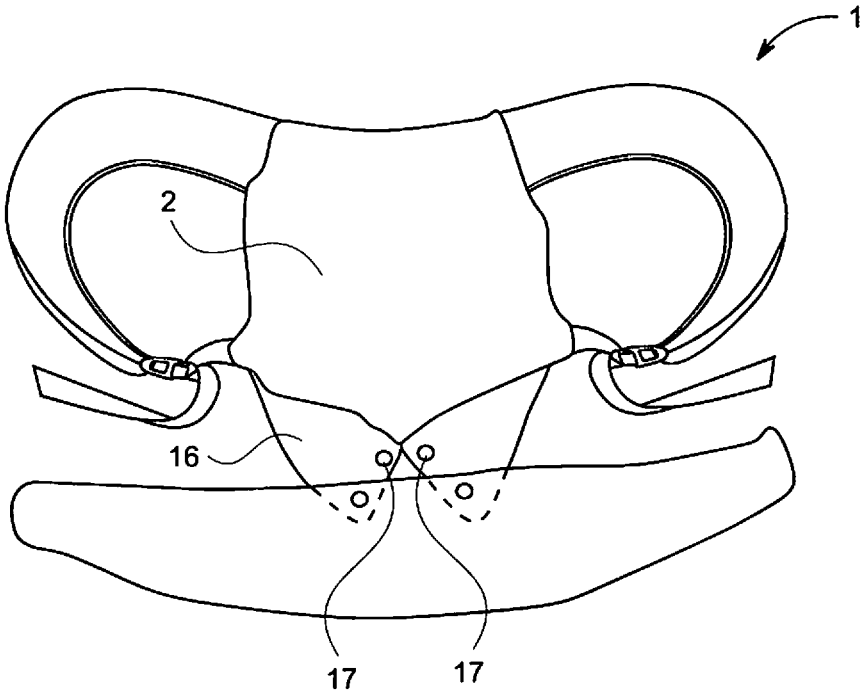
FIG. 8 illustrates an underside plan view of the baby carrier of FIG. 1 in a front outwards facing mode.

With reference to FIGS. 7 and 8, a perspective and plan view respectively is shown of a baby carrier apparatus 1 in front mode where the child faces outwards with respect to the wearer. As shown, the seat width is narrowed by moving the side members 16 in an inward direction with the domes 17 being repositioned inwards from their normal position into the centre of the carrier 1, in order to narrow the main body 2 or front seat section, best seen in FIG. 8. The narrowed front seat section is specific to this carrying mode alone and allows for a child who is 6 months or older to sit front face out ergonomically. If the seat width is not narrowed then the hips and legs are too far spread (as the seat would be too wide for the legs to wrap around), which negates the ergonomically accurate natural human position and causes discomfort to the child.

Example 4—Back Mode (Mode 3)

Figure 9:
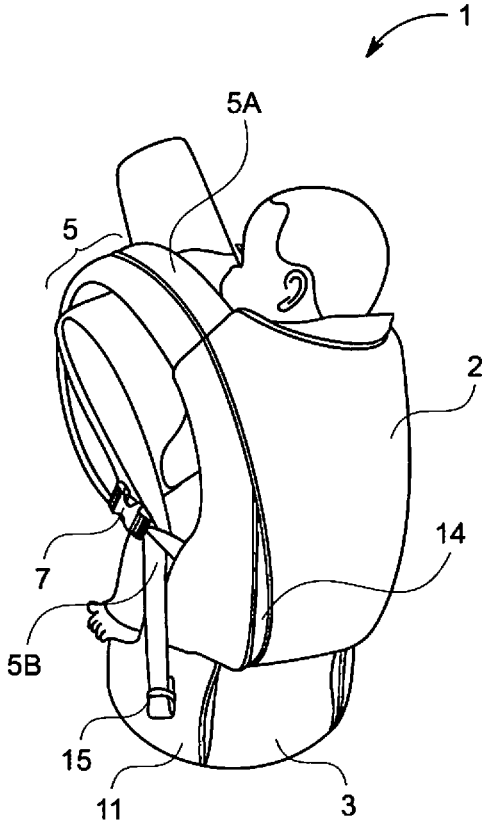
FIG. 9 illustrates a perspective of the baby carrier of FIG. 1 in back mode.

With reference to FIG. 9, a perspective is shown of a baby carrier apparatus 1 in backpack mode where the child is carried on the back of the wearer. In this mode, the seat width is in its widest configuration with the seat domes 17 being fastened in their normal position; on the inside of the waistband on either side of the parents' hip. This configuration ergonomically supports a child who is 6 months or older. Here the carrier 1 is turned around and sternum strap 9 crosses the chest. The sternum strap runners 8 provide an easy adjustment of the height of the sternum strap 9 to comfortably suit different body shapes and sizes. The relatively long length of the main body 2 or seat section/front panel of the carrier 1 helps to ensure that the fabric support reaches the shoulder blades or is higher than the shoulders of the child when being used in back mode. This is for safety reasons to make sure the child does not fall back and out of the carrier 1 and is firmly supported within the structure.

Example 5—Hip Mode (Mode 4)

Figure 10:
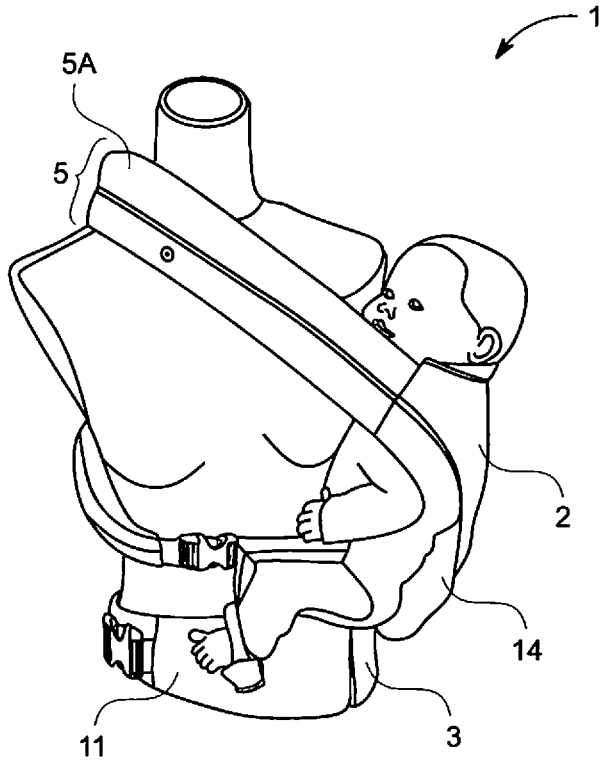
FIG. 10 illustrates a perspective view of the baby carrier of FIG. 1 in hip mode.

With reference to FIG. 10, a perspective is shown of a baby carrier apparatus 1 in hip mode where the child faces inwards and is carried on the hip of the wearer. In this mode, the seat width is in its widest configuration with the domes 17 being fastened in their normal position i.e. on the inside of the waistband 3 on either side of the parent's hip This configuration ergonomically supports a child who is 6 months or older. Here the shoulder straps 5 are crossed over each other and around the parent's neck and shoulders and the sternum strap buckle 10 is not used in this configuration. As shown, the child is positioned on the side of the parent and the weight is carried through the hip area. The wide waistband and padded shoulder straps assist to make this mode more comfortable for the parent by providing a padded surface in which the weight is predominantly carried on.

Example 6—Use Of Extendable Insert

Figure 13:
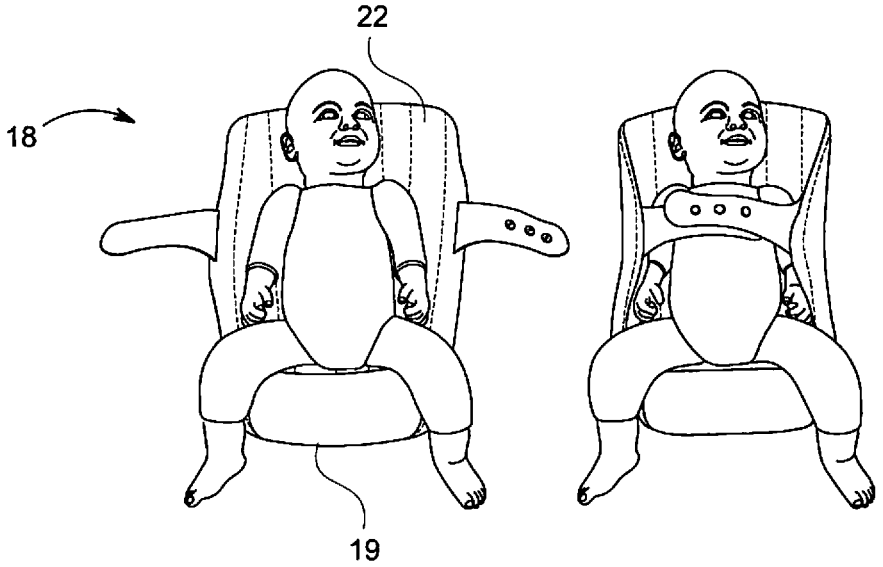
FIG. 13 illustrates a front view of a baby utilising the insert embodiment with a base or seat in a first position for use with the baby carrier of FIG. 1 in a front outwards facing mode.
Figure 14A:
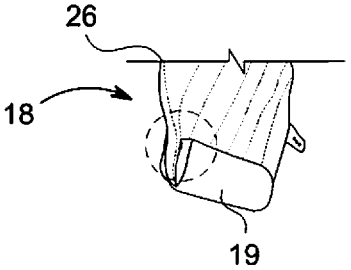
FIGS. 14A-D illustrate a plan view of the transition of the base or seat from a first and second position for use with a baby carrier of FIG. 1 in a front outwards facing mode.
Figure 14C:
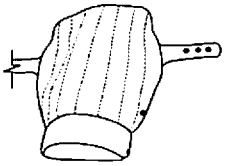
Figure 14B:
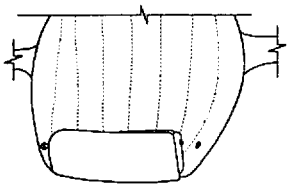
Figure 14D:
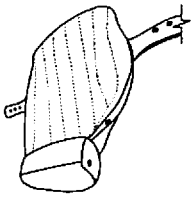
Figure 15:
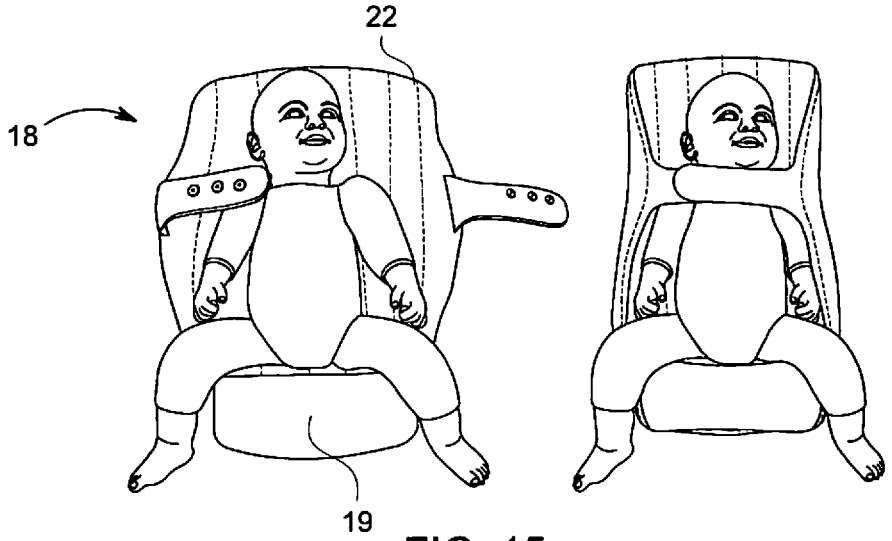
FIG. 15 illustrates a front view of a baby utilising the insert embodiment with a base or seat in a second position for use with the baby carrier of FIG. 1 in a front outwards facing mode.

With reference to FIGS. 13, 14 and 15 respectively, a baby is shown using the insert 18 with a base or seat 19 used in both a first (standard) position and second (extended) position respectively. In particular, FIG. 13 shows a baby in a strapped and unstrapped position when the base or seat 19 is in a first position where the where the seat is domed to the to the curved side walls 26 allowing for a foam padded back 22 with a height of 430 mm (best seen in FIG. 11).

FIG. 14 shows the steps to transition the insert 18 from the first position to the second extended position where the seat 19 is unfastened from the side members 26, then inverted, 'flipped over' or moved upside down to a second position (best seen in FIG. 12), Once the seat 19 is flipped over, the foam padded back support 22 is also inverted or turned inside out where the inside or inner material of the back support 22 becomes the outside or outer material of the back support 22 when the insert is in the extended position or configuration. This configuration allows the base or seat 19 to remain attached to the bottom edge of the back support 22 and without a fastener when in the second position, such that the back support 22 is extendible by an exemplary further 70 mm relative to the base i.e. an insert with a back height of 500 mm as shown in FIG. 15 where a baby is in a strapped and unstrapped position when the base or seat 19 is in the second position.

Aspects of the present invention have been described by way of example only and it should be appreciated that modifications and additions may be made thereto without departing from the scope of the claims herein.

What is claimed is:

1. A multi-functional baby carrier comprising:

two strap loops which are interconnected and configured to extend around shoulder or back areas of a wearer;

a main body attached to the two strap loops, the main body forming a seat portion to support a baby having at least two moveable side members configured to adjust a width of the main body portion; and a waistband attached to a lower end of the main body;

wherein the adjustment of the width of the main body portion is altered to a narrow position when a portion of the side members are folded back substantially inwards towards a centreline of the main body and retained in position when in a front face outward mode;

wherein two outer dome fasteners of each side member are un-domed and re-fastened in an inward direction to form a narrower main body section on the carrier to ergonomically support the front face out mode such that once re-fastened into the narrow position, the side members lie underneath a layer of material positioned on an underside of the waistband; and wherein an interior side of the waistband includes a layer of material that covers the moveable side members when in a front face inward, back and hip modes respectively.

2. The baby carrier as claimed in claim 1, wherein the baby carrier includes four carry modes of operation.

3. The baby carrier as claimed in claim 2, wherein the four carry modes of operation are front face mode inwards or outwards, back mode and hip mode.

4. The baby carrier as claimed in claim 1, wherein the two strap loops are interconnected via an adjustment means comprising a sternum strap and fastener.

5. The baby carrier as claimed in claim 1, wherein the two strap loops include a shoulder strap fastener, one on each side of the two strap loops to allow a wearer to detach the main body of the carrier from the strap loops, wherein the main body portion is still attached to a waistband section of the carrier.

6. The baby carrier as claimed in claim 1, wherein loose strap ends at a distal end of the two strap loops include an elastic band.

7. The baby carrier as claimed in claim 1 wherein the two strap loops include a binding positioned substantially on a middle section of each loop and running along the length of the strap.

8. The baby carrier as claimed in claim 7, wherein a fastener is configured to engage and move up and down the binding for height adjustment of a sternum strap.

9. The baby carrier as claimed in claim 1, wherein the waistband attached to the main body is dimensioned to act as a weight distribution aid.

10. The baby carrier as claimed in claim 9, wherein the waistband includes a fastener for removably releasing the waistband from a wearer and is dimensioned to ensure a secure connection along with a strap to allow for adjustments to be made to the width of the waistband, thereby providing an ergonomic fit for different sized wearers.

11. The baby carrier as claimed in claim 1, wherein the two moveable side members include fasteners to removably attach the side members.

12. The baby carrier as claimed in claim 11, wherein the fasteners are dome fasteners.

13. The baby carrier as claimed in claim 11, wherein the two side members are secured by at least two dome fasteners on each side, wherein the dome fasteners are concealed within an underside of a waistband within an open pocket when in the front face inwards, back and hip modes respectively.

14. The baby carrier as claimed as claimed in claim 5, wherein the waistband includes a pocket located on each side of the waistband.

15. The baby carrier as claimed in claim 14, wherein the pocket includes an opening with an elasticated mechanism configured to allow the pocket opening to revert back into position such that the pocket opening may lay substantially against the waistband when not in use.

16. The baby carrier as claimed in claim 1, wherein the main body includes an internal hood storage pocket section wherein a hood is stored in the hood storage pocket section located therein between internal and external fabric layers.

17. The baby carrier as claimed in claim 16, wherein the hood has an elastic edge for expanding the size of the hood and retaining the hood over a child's head.

18. The baby carrier as claimed in claim 16, wherein the hood include straps with fasteners that engage with corresponding fasteners located on shoulder straps to retain the hood over a child's head when in use.

19. The baby carrier as claimed in claim 1, wherein the baby carrier includes an insert configured to engage with the main body without requirement of separate fasteners to retain into position.

20. The baby carrier as claimed in claim 19, wherein the insert includes a restraint system in the form of at least one strap to secure the child within the insert.

21. The baby carrier as claimed in claim 20, wherein the strap includes a fastener in the form of a dome to retain the strap in an adjusted position.

22. The baby carrier as claimed in claim 20, wherein the strap is placed over or under a baby's arms.

23. The baby carrier as claimed in claim 19, wherein the insert includes adjustable curved side walls that fit around a body of a child in an adjusted position.

24. The baby carrier as claimed in claim 19, wherein the insert includes an elevated base or seat to raise newborns in a higher position when in the carrier.

25. The baby carrier as claimed in claim 19, wherein the insert includes a padded back to provide structural support to the insert and act as additional head and neck support for newborn babies.

26. The baby carrier as claimed in claim 19, wherein the insert includes vertical stitch lines or seams to secure internal foam to external fabric of the carrier, wherein the seams provide extra structural integrity allowing the side walls of the carrier to curve around the baby.

27. The baby carrier as claimed in claim 1, wherein a piece of material overlaps the main body to form a pouch configured to allow a wearer to pass their hands right through an opening created therein between the piece of material and the main body.

28. A baby carrier as claimed in claim 27, wherein the pouch is accessed from either side of the carrier, wherein the sides of the pouch are not enclosed.

* * * * *